US007735179B2

(12) United States Patent
Dawes

(10) Patent No.: US 7,735,179 B2
(45) Date of Patent: Jun. 15, 2010

(54) TOOTHBRUSH HAVING PIVOTING HEAD

(76) Inventor: Jeffrey L. Dawes, 2521 Twin Oaks Dr., Lebanon, OH (US) 45036

( * ) Notice: Subject to any disclaimer, the term of this patent is extended or adjusted under 35 U.S.C. 154(b) by 768 days.

(21) Appl. No.: 11/615,735

(22) Filed: Dec. 22, 2006

(65) Prior Publication Data

US 2007/0143943 A1 Jun. 28, 2007

Related U.S. Application Data

(60) Provisional application No. 60/597,915, filed on Dec. 23, 2005.

(51) Int. Cl.
*A46B 9/04* (2006.01)

(52) U.S. Cl. ..... 15/172; 15/167.1; 15/201

(58) Field of Classification Search ..... 15/167.1, 15/172, 201
See application file for complete search history.

(56) References Cited

U.S. PATENT DOCUMENTS

| | | | | |
|---|---|---|---|---|
| 3,196,299 | A * | 7/1965 | Kott | 310/81 |
| 3,214,776 | A | 11/1965 | Bercovitz | |
| 5,491,866 | A | 2/1996 | Simonds | |
| 5,499,422 | A | 3/1996 | Lavazoli | |
| 5,813,075 | A | 9/1998 | Graur | |
| 5,884,354 | A | 3/1999 | Anderson | |
| 5,979,005 | A | 11/1999 | Lecce | |
| 6,931,688 | B2 | 8/2005 | Moskovich et al. | |
| 6,957,469 | B2 * | 10/2005 | Davies | 15/167.1 |
| 2005/0273961 | A1 | 12/2005 | Moskovich et al. | |

* cited by examiner

*Primary Examiner*—Shay L Karls
(74) *Attorney, Agent, or Firm*—Lafkas Patent LLC; David M. Lafkas; Matthew E. Vale

(57) ABSTRACT

The present invention includes a toothbrush having a handle attached to a head. The head may rotate positions relative to the handle to improve brushing of both teeth and tongue of a user.

7 Claims, 5 Drawing Sheets

TOOTHBRUSH HAVING PIVOTING HEAD

CROSS-REFERENCE TO RELATED APPLICATION(S)

The present application for a patent claims priority to U.S. Provisional Patent Application No. 60/597,915 as filed Dec. 23, 2005.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

This invention relates generally to dental care apparatuses, and particularly relates to a toothbrush having a handle and pivoting head of cleaning elements, such as, for example, bristles, tufts, and the like. Toothpaste is applied to the cleaning elements and then inserted into the mouth of a user in order to brush the user's teeth and tongue.

2. Description of the Related Art

Conventionally, a toothbrush comprises a handle and a head attached to the handle. Sometimes the handle and the head are a single piece, but may be separable as well.

Typically, the head of the toothbrush includes fixed cleaning elements extending outwardly from at least one side of the head of the toothbrush. Throughout the prior art, there have been attempts to alter the flexibility, movement, and form of these cleaning elements.

For example, U.S. Pat. No. 5,491,866 describes an articulate toothbrush having a pivot joint connecting the handle and the head.

U.S. Pat. Nos. 3,214,776 and 5,813,075 disclose a toothbrush having a manual provision for rotating the head of a toothbrush clockwise or counterclockwise relative to the handle. In other words, when looking at the toothbrush from a top view, the head twists clockwise and counterclockwise around longitudinal sides of the handle.

There are additional dental hygiene considerations beyond merely cleaning one's teeth. Many individuals also enjoy cleaning one's tongue. However, the conventional shape of a toothbrush head being substantially rectangular with the longitudinal sides parallel to the toothbrush handle makes it somewhat difficult to properly clean one's tongue. Having the longitudinal sides of the toothbrush head being perpendicular to the handle makes cleaning the tongue easier and more efficient.

A toothbrush head with the longitudinal sides of the toothbrush head being perpendicular to a central axis of the handle makes properly brushing one's teeth difficult though.

Thus, what is desired is a toothbrush in which the head may pivot such that the longitudinal sides of the toothbrush head may be substantially parallel to the handle, substantially perpendicular to the handle, and any desired angle between.

SUMMARY

The various exemplary embodiments of the present invention include a toothbrush comprising a handle having a central axis and an elongated head. The elongated head has longitudinal sides, a top end, a bottom end, a front side, and a back side. Cleaning elements extend outwardly from the elongated head at least on the front side. The elongated head is attached to the handle by each of a first support and a second support, such that the first support may be moved in a direction substantially parallel to the central axis of the handle in order to rotate the elongated head. The elongated head may rotate from a first position wherein the longitudinal sides of the elongated head are substantially parallel to the central axis of the handle to at least a second position wherein the longitudinal sides of the elongated head are substantially perpendicular to the central axis of the handle.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Figure 1:
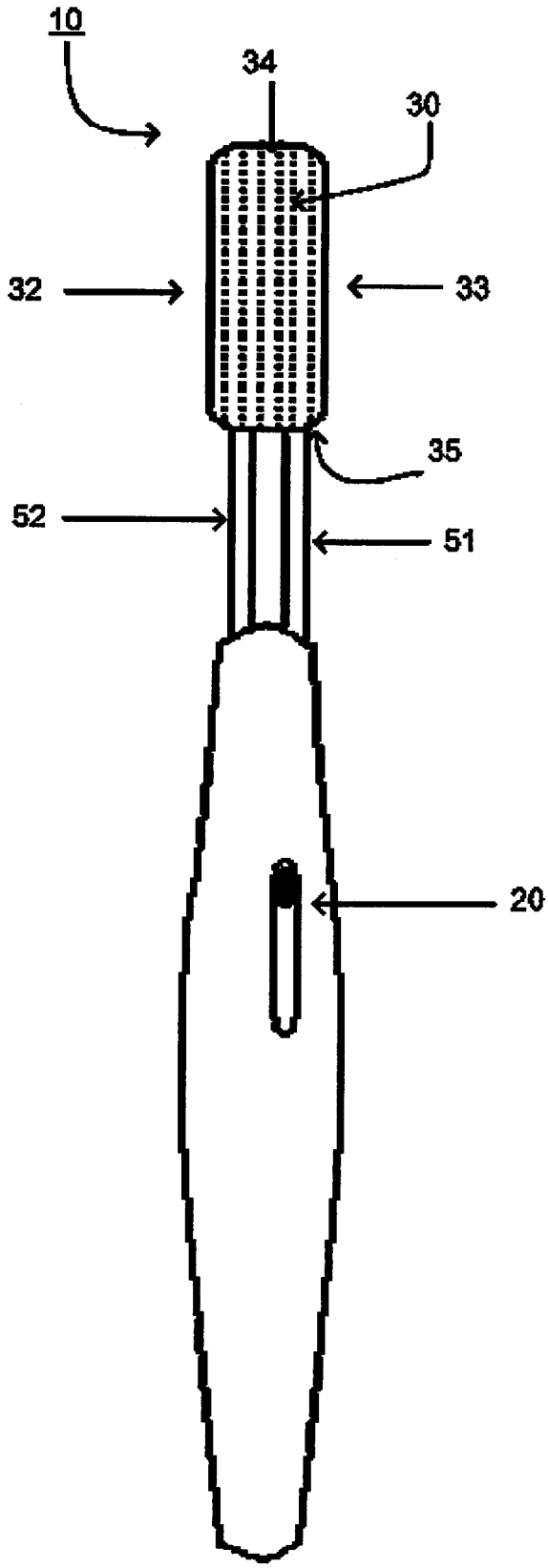
FIG. 1 is an illustration of a front view of a toothbrush according to the various exemplary embodiments of the present invention such that the longitudinal sides of the elongated head are substantially parallel to the central axis of the handle.
Figure 2:
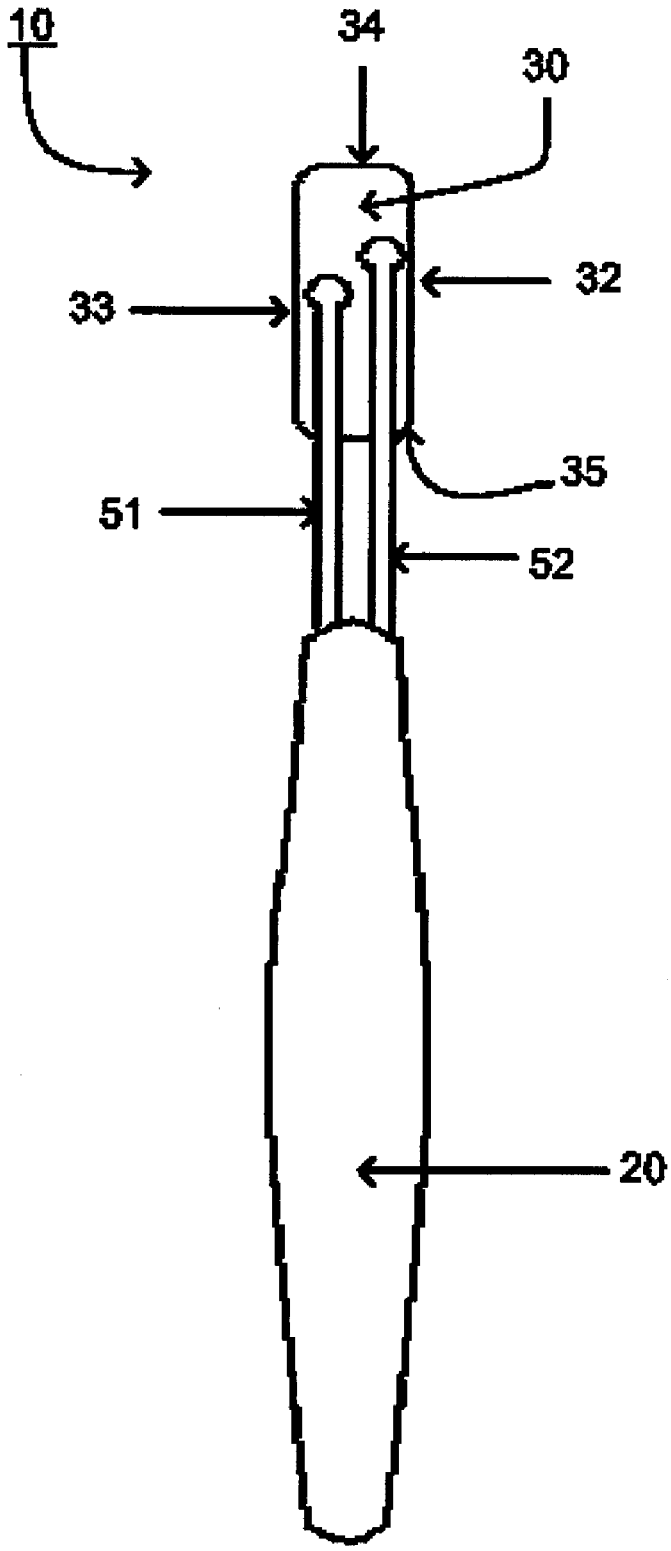
FIG. 2 is an illustration of the back view of the embodiment illustrated in FIG. 1.

One of the various exemplary embodiments of the present invention is represented in FIG. 1 in which a toothbrush 10 is shown comprising a handle 20 and an elongated head 30 attached to the handle.

The handle represented in FIG. 1 and subsequent drawings is shaped as a substantially elongated cylinder to simplify understanding of the invention as whole. However, the handle 20 may potentially be of any desired shape.

In the various exemplary embodiments, the elongated head 30 comprises longitudinal sides 32 and 33, a top end 34, a bottom end 35, a front side 36, and a back side 37. Although the elongated head is shown as being primarily rectangular, it may be of any elongated shape.

In the various exemplary embodiments, the cleaning elements are preferably at least on the front side 36 and extend away from the elongated head 30. The cleaning elements may comprise bristles, rubber picks, rubber flaps, or a combination thereof. The cleaning elements shown in the figures are bristles 40 and are grouped in a substantially linear pattern on the front side of the elongated head. However, the cleaning elements may be arranged in any linear pattern, non-linear pattern, or combination thereof.

As shown in FIG. 1, the elongated head is substantially parallel to a central axis of the handle 20. This is the traditional position of an elongated head of a toothbrush in relation to the handle.

Figure 3:
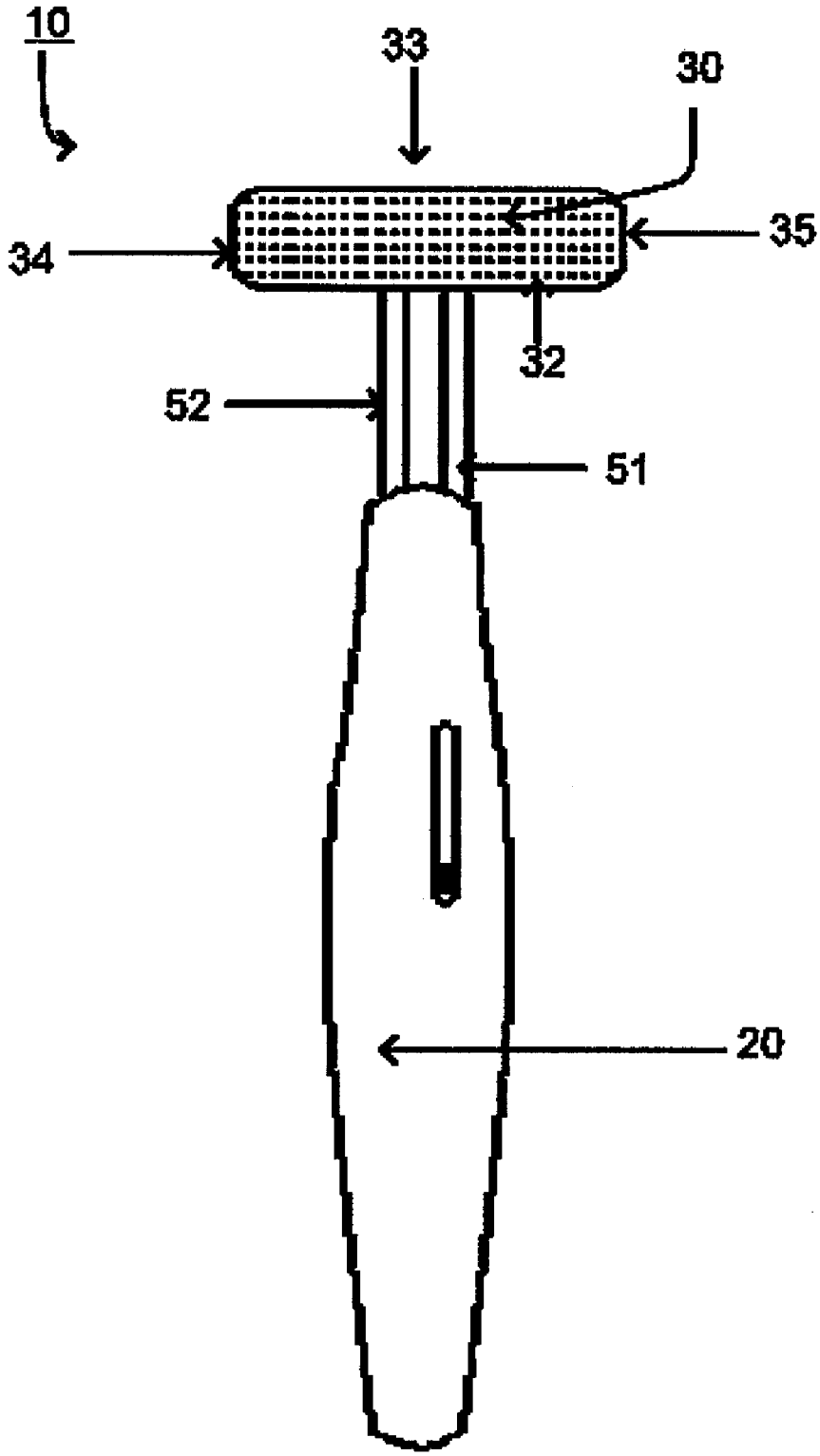
FIG. 3 is an illustration of a front view of a toothbrush according to the various exemplary embodiments of the present invention such that the longitudinal sides of the elongated head are substantially perpendicular to the central axis of the handle.
Figure 4:
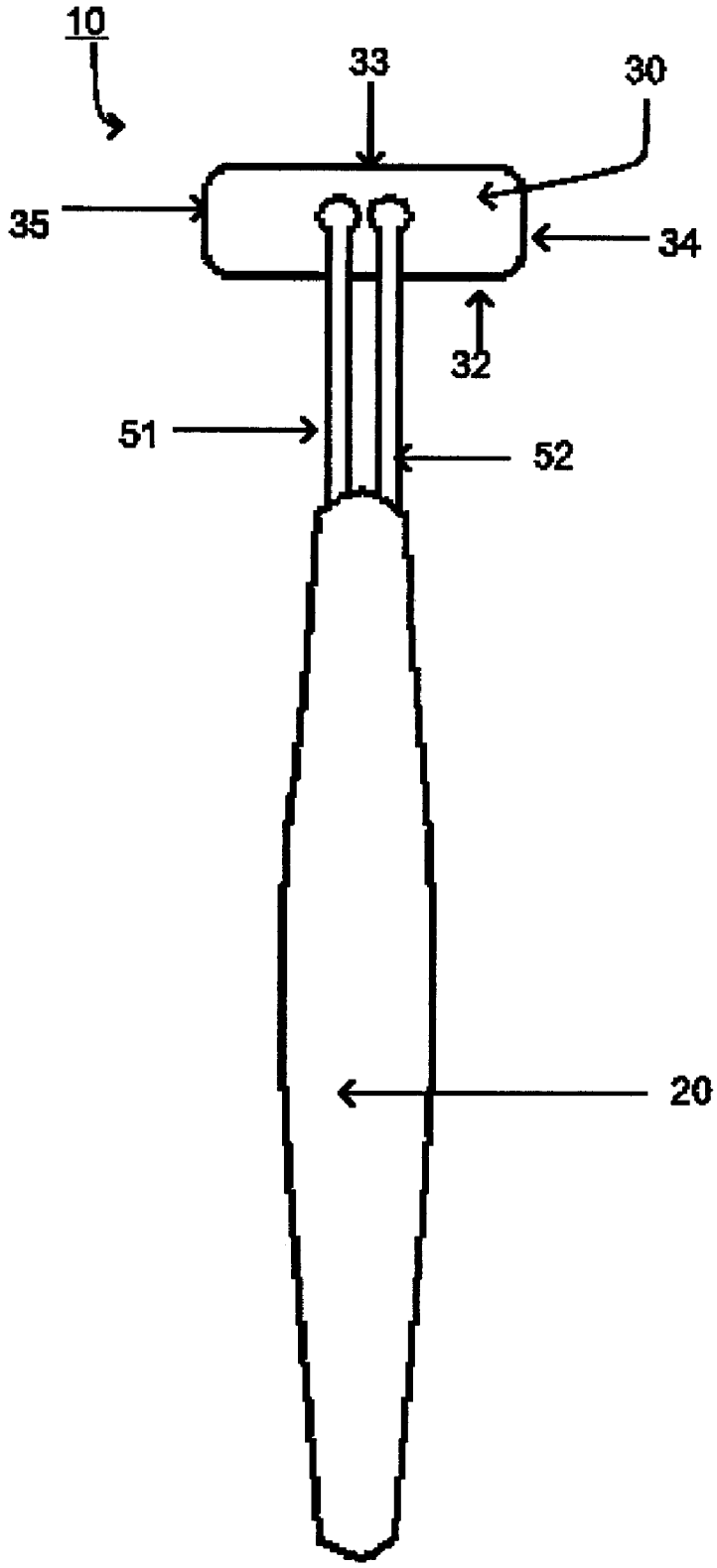
FIG. 4 is an illustration of the back view of the embodiment illustrated in FIG. 3.
Figure 5:
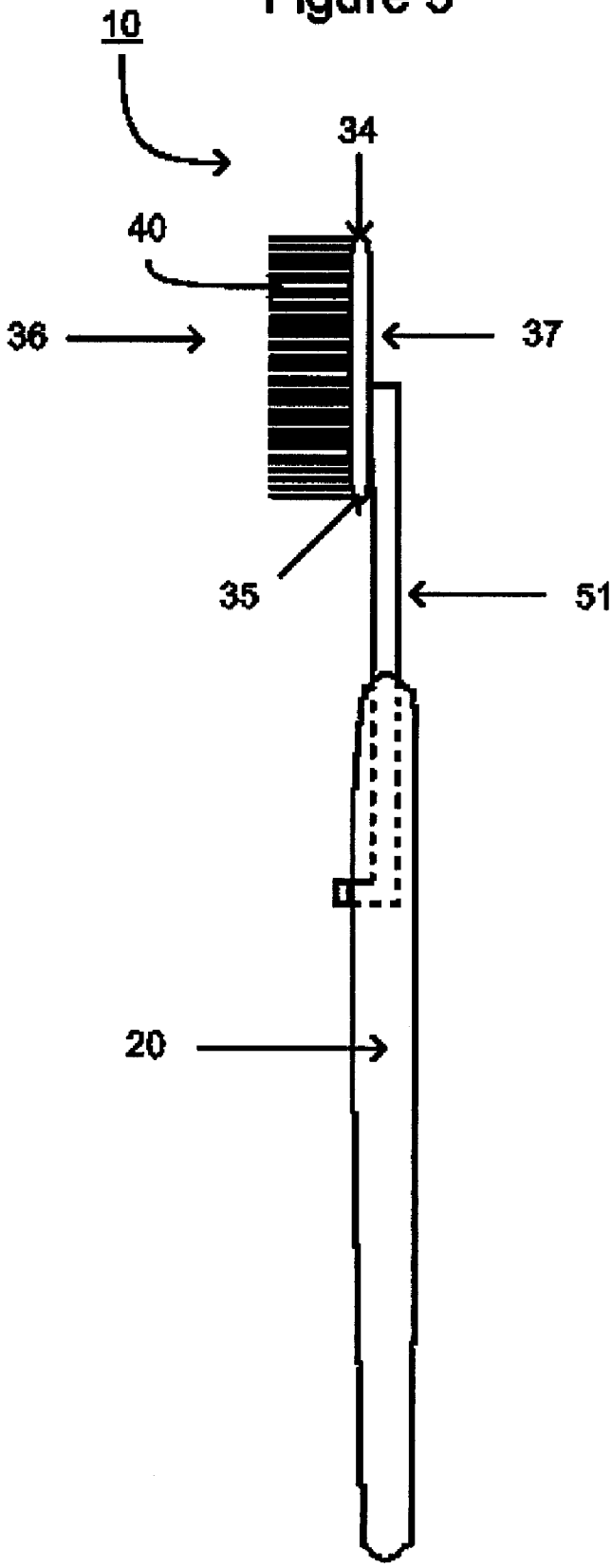
FIG. 5 is an illustration of a side view of a toothbrush according to the various exemplary embodiments of the present invention such that the longitudinal sides of the elongated head are substantially parallel to the central axis of the handle.

In FIG. 3, however, the elongated head 30 is substantially perpendicular to the central axis of the handle 20. In the elongated head of the toothbrush is now in a position relative to the handle that allows for easier and more efficient cleaning of an individual's tongue.

As shown in FIG. 3, the elongated head has rotated about ninety degrees such that the longitudinal sides 32 and 33 of the elongated head 30 are substantially perpendicular to the central axis of the handle 20.

In a preferred embodiment, the elongated head 30 is attached to the handle 20 via a first support 51 and a second support 52. The first support and the second support are shown as rods connecting the handle to the elongated handle.

In the various exemplary embodiments comprising the first support and the second support, the second support is substantially static. That is, the second support preferably does not move. However, the end of the second support that is attached to the elongated head allows the elongated head to rotate about the second support.

In these various exemplary embodiments, the first support is attached to the handle such that the first support may slide up and down in the direction of the central axis of the handle. The first support is attached to the elongated head in a linear track (not shown) such that as the first support is moved upwards, the end of the first support attached to the elongated head moves the elongated head to a position such that the longitudinal sides are substantially parallel to the central axis of the handle. Likewise, as the first support is moved downwards, the he end of the first support attached to the elongated head moves the elongated head to a position such that the longitudinal sides are substantially perpendicular to the central axis of the handle. In either movement, the second support does not move, but the elongated head rotates about the second support.

In a preferred embodiment, the first support may be locked into position such that the longitudinal sides of the elongated head are substantially parallel or substantially perpendicular to the central axis of the handle.

Further, in another embodiment, the first support may be locked into positions between the positions in which the longitudinal sides of the elongated head are substantially parallel or substantially perpendicular to the central axis of the handle. Teeth or slots may be used to lock the first support into position.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A toothbrush comprising:

a handle having a central axis; and an elongated head having longitudinal sides, a top end, a bottom end, a front side, and a back side, wherein cleaning elements extend outwardly from the elongated head at least on the front side; the elongated head being attached to the handle by means of a first support and a second support that are both directly attached to the elongated head, such that the first support may be moved in a direction substantially parallel to the central axis of the handle in order to rotate the elongated head, and wherein the elongated head may rotate from a first position wherein the longitudinal sides of the elongated head are substantially parallel to the central axis of the handle to at least a second position wherein the longitudinal sides of the elongated head are substantially perpendicular to the central axis of the handle.

2. The toothbrush according to claim 1, wherein the handle comprises an adjusting means for rotating the elongated head.

3. The toothbrush according to claim 2, wherein the adjusting means is a lever.

4. The toothbrush according to claim 2, wherein the adjusting means is lockable.

5. The toothbrush according to claim 1, further comprising a power source.

6. The toothbrush according to claim 1, wherein the cleaning elements are bristles.

7. The toothbrush according to claim 1, wherein the cleaning elements are rubbery picks.

* * * * *